United States Patent [19]

Davis

[11] Patent Number: 4,520,529

[45] Date of Patent: Jun. 4, 1985

[54] SEED DELINTER

[76] Inventor: Boyce W. Davis, 3902 E. Bronco Trail, Phoenix, Ariz. 85044

[21] Appl. No.: 525,937

[22] Filed: Aug. 24, 1983

[51] Int. Cl.[3] ..... D01B 1/04

[52] U.S. Cl. ..... 19/41; 19/44

[58] Field of Search ..... 19/40, 41, 42, 44, 43, 19/45, 46, 47

[56] References Cited

U.S. PATENT DOCUMENTS

| | | | |
|---|---|---|---|
| 546,275 | 9/1895 | Faulkner | 19/41 |
| 983,527 | 2/1911 | Worth | 19/44 |
| 1,319,199 | 10/1919 | Young | 19/43 |
| 2,144,579 | 1/1939 | Sheppard | 19/44 |
| 2,644,986 | 7/1953 | Pazandak | 19/44 |
| 2,724,148 | 11/1955 | McMath | 19/44 |
| 3,805,332 | 4/1974 | Williams et al. | 19/44 |
| 4,154,021 | 5/1979 | Griffith | 19/41 X |

*Primary Examiner*—Louis K. Rimrodt

*Attorney, Agent, or Firm*—Warren F. B. Lindsley

[57] ABSTRACT

An apparatus for delinting cottonseed employing an abrasive surface rotor having a wire mesh drum coaxially mounted therearound defining an annular space therebetween and both mounted for rotation relative to each other, means for forcing cottonseeds into said annular space and in contact with said abrasive surface to remove lint therefrom and out of a controlled seed outlet, and an air stream passing through said annular space and out of said apparatus with lint entrained within it and means for trash to drop through spacings of the wire mesh drum onto a conveyor.

9 Claims, 6 Drawing Figures

SEED DELINTER

BACKGROUND OF THE INVENTION

This invention relates to the processing of cottonseeds, and more particularly, to the removing of lint or linters from the seeds.

In the processing of cotton, cotton picked from its plant is ginned so as to remove the long, staple fibers from the seeds. The seeds are then processed so as to remove remaining lint or linters, used as a cellulosic material in industry. The delinted cottonseed is then processed to separate the meat from the hulls with oil extracted from the meat and the meat then used as livestock feed and the like.

DESCRIPTION OF THE PRIOR ART

Seed delinting apparatus for removing lint fibers from cottonseeds and the like have been known, but none have performed entirely satisfactorily.

Some of the prior art have employed a series of cylindrical saws that effect a clawing action to remove the lint from the seeds. These saw type delinters have been noisy in operation and chip and scale small particles of the outer pigment layer of the seed coat resulting in contamination of the lint. Such contamination reduces the quality and value of the lint.

Brush type delinters cause excessive breakage of the seed also resulting in lint contamination and clogging of the brushes resulting in operational difficulties. Some of these processes are disclosed in U.S. Pat. Nos. 2,644,986 and 2,724,148.

U.S. Pat. No. 3,805,332 discloses an apparatus for delinting cottonseed lined with abrasive material and employing a rotor disposed within the casing to force the seeds along a generally spiral path in contact with the abrasive material. An air stream passing through the casing entrains the lint and carries it through the lint outlets.

SUMMARY OF THE INVENTION

In accordance with the invention claimed, a new and improved apparatus is disclosed for delinting cottonseed. This apparatus employs a delinting chamber consisting of a generally cylindrical casing which is at least partially tapered and at least partially covered with abrasive material, and a revolving drum surrounding the abrasive roll. The revolving drum is at least partially covered with perforated metal, wire mesh, or other material suitable to allow immediate passage of the lint as it is detached from the seeds and yet retain the seeds in a position close to the abrasive roll. The revolving drum rotates past at least one air nozzle or hood which immediately removes the lint from the apparatus as the lint passes through the drum. An undelinted seed chute is employed to introduce the undelinted seeds into a feeder roll having a helical flight to force feed the seeds into the delinting chamber.

It is, therefore, one object of this invention to provide a new and improved cottonseed delinter device which will effect substantially complete separation of the lint from the seed.

Another object of this invention is to provide a new and improved cottonseed delinter apparatus employing an abrasive roll in cooperation with a revolving wire mesh drum for removing lint from the seeds with minimum damage to the seeds.

A further object of the invention is to provide a seed delinter employing an abrasive roll within a revolving wire mesh drum, the cooperating parts of which are relatively adjustable to compensate for wear of the abrasive roll.

A still further object of this invention is to provide a conveyor system extending along the length of its casing for separating and removing trash from the lint.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
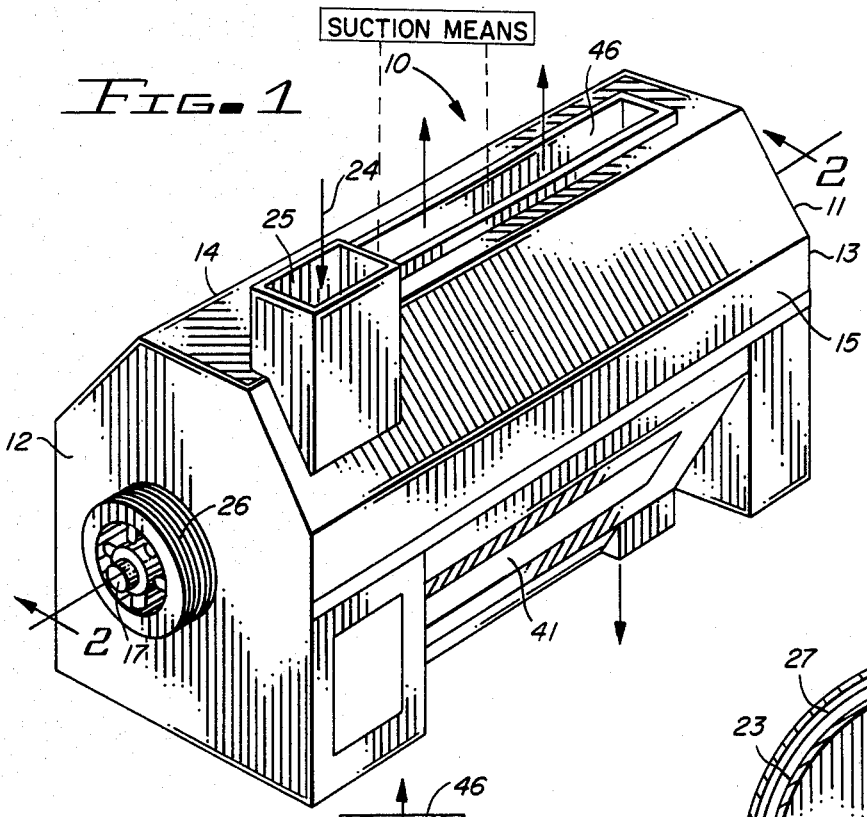
FIG. 1 is a perspective view of a seed delinter embodying the invention.
Figure 3:
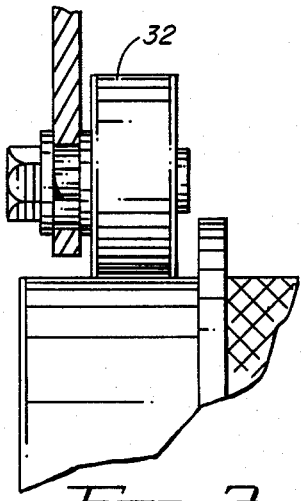
FIG. 3 is an enlarged view of the circled area of FIG. 2 given the reference character 3.
Figure 5:
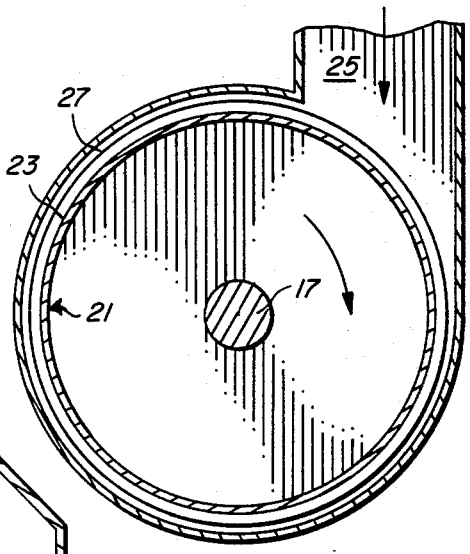
FIG. 5 is a cross-sectional view of FIG. 2 taken along the line 5—5.
Figure 2:
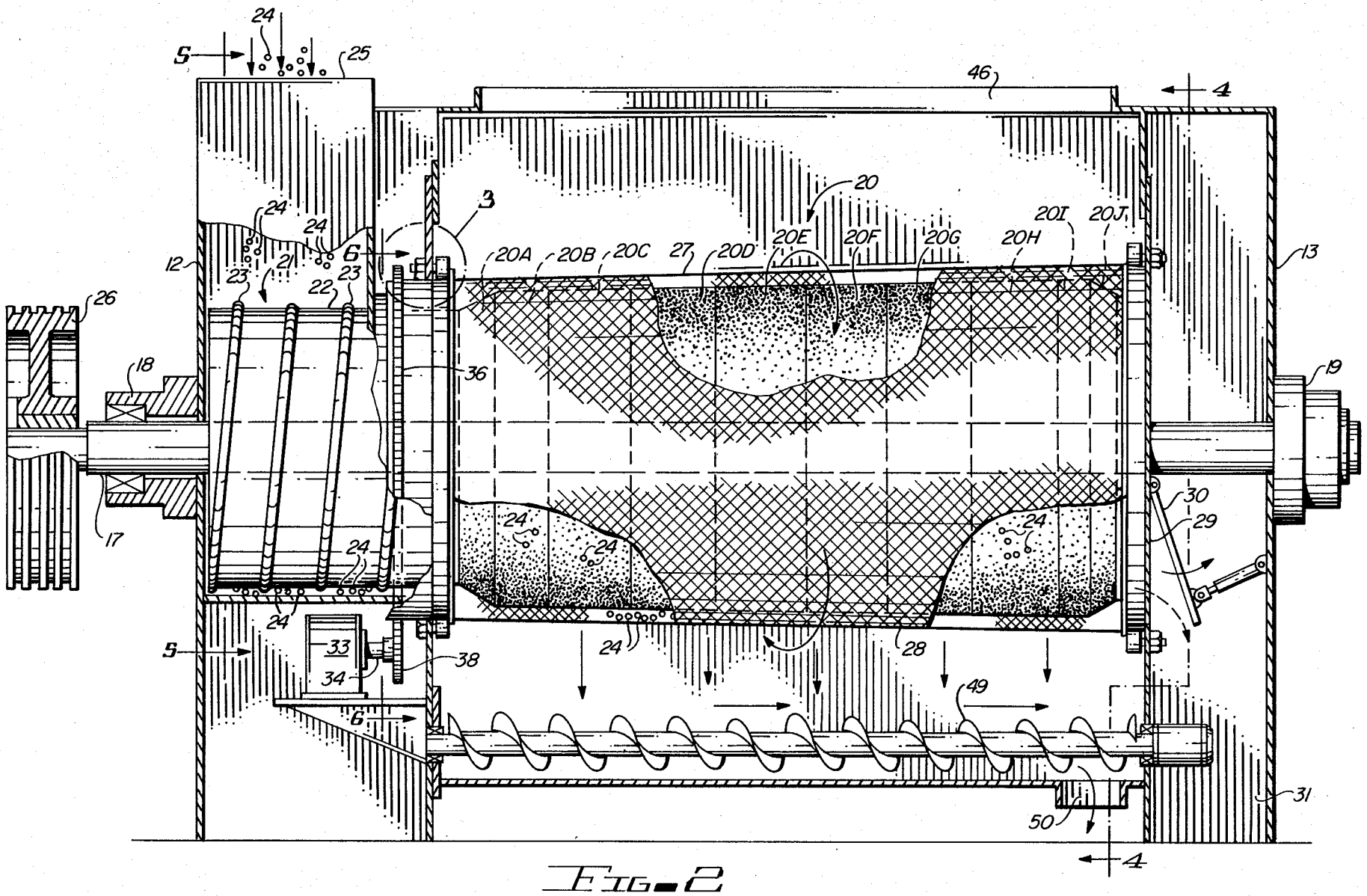
FIG. 2 is a cross-sectional view of FIG. 1 taken along the line 2—2.

Referring more particularly to the drawing by characters of reference, FIGS. 1–6 disclose a seed delinter 10 comprising an elongated housing 11 preferably enclosed at both ends by plates 12 and 13, as shown in FIGS. 1 and 2. The sides 14 and 15 of housing 11 may be of any suitable elongated geometrical form enclosing within them and spaced therefrom a generally cylindrical hood 16 which fits around and substantially encloses the seed delinting apparatus.

The seed delinting apparatus comprises a metallic shaft 17 extending longitudinally through housing 11 and its end plates 12 and 13 and is journaled at each end in suitable bearings 18 and 19 attached to each end of the housing.

An abrasive roll 20 is formed on shaft 17 by the assembly thereon of a plurality of disc or sleeve shaped segments illustrated in FIG. 2 as 20A–20J, but not being limited to a specific quantity. At least one of the abrasive segments is conical in shape as illustrated by segments 20A and 20J and the arrangement of said segments is not limited to that shown. The left end of shaft 17 is provided with a drum shaped configuration 21 of a diameter substantially equal to the smallest diameter of segment 20A with its outer surface 22 provided with a plurality of helical ridges 23 which are intended to convey undelinted seeds 24 dropped from a suitable feeder through an opening 25 formed in housing 11 onto the outer surface 22 of the drum shaped configuration 21 which are then conveyed over the outer surface of segments 20A–20J of the abrasive roll formed thereby from left to right, as shown in FIG. 2.

As may be seen in FIG. 2, shaft 17 is rotatably journaled within housing 11 with a pulley 26 attached to its left end with suitable belts coacting with the pulley of a motor (not shown) for purposes of driving the abrasive roll 20.

As shown in FIGS. 2, 4, 5 and 6, a revolving wire mesh or perforated drum 27 is coaxially mounted around a rotor or roll 20 for holding the seed, such as cottonseed, close to the outer surface of the abrasive roll 20 while it is rotating so as to cause removal of the lint from the cottonseed by abrasive action.

The drum 27 is adjustably mounted within housing 11 so that its mesh wire surface may be moved close to the outer periphery of the abrasive roll 20 as the diameter of the segments 20A–20J decrease as a result of wear.

It should be noted that an annular space 28 is provided between the outer periphery of the segments 20A–20H of the roll 20 and the interior surface of the wire mesh forming the drum 27. This annular space 28 should be greater than the average minor dimension of the seeds being processed and preferably is of a width of about ½ of an inch to about 1 inch for cottonseed so as to provide sufficient but not excessive clearance between the wire mesh of drum 27 and the outer surface of the abrasive segments 20A–20J so that the seeds are not crushed or broken as they pass longitudinally through this annular space 28. If excessive clearance is provided between mesh surface of drum 27 and the abrasive segments 20A–20J, the seeds will not make intimate contact with the abrasive material for purposes of separating lint from the seed.

Thus, as the seed is dropped from a suitable feeder (not shown) through the opening 25 onto the outer surface of drum shaped configuration 21, it is moved by the helical ridges 23 on drum shaped configuration 21 through the annular space 28 in substantially tangential relationship to the inner surface of the wire mesh of drum 27 and the outer surface of roll 20.

A seed outlet 29 is formed at the right end of the delinter, as shown in FIG. 2, for withdrawing the delinted seed from the apparatus. A cover 30 may be adjusted to increase or decrease the open area of the seed outlet 29 depending upon the amount of seed to be retained within delinter 10 for a given length of time. As shown in FIG. 2, the seeds passing through the seed outlet pass downwardly and out of housing 11 through a chute 31 into a suitable receptacle (not shown).

With regard to the drum shaped configuration 21 and its helical ridges 23, feeding of the seeds through the delinter may occur at a fixed rate and with cover 30 open, the seeds pass through the delinter in a thin layer and in a relatively short time. At the same feed rate, if cover 30 is partially closed, the layer of seed in the delinter becomes more dense and thicker and remains in the delinter a longer period of time. Thus, the cover 30 may be adjusted to hold seed in the delinter long enough to take off the desired amount of lint from the seed.

In accordance with the invention disclosed, the wire mesh drum 27 is axially mounted around roll 20 formed by the abrasive segments 20A–20J and is adjustably held in a given arrangement therewith by a plurality of guide rollers 32.

The wire mesh drum 27 is rotated relative to the mandrel formed by the abrasive segments 20A–20J forming roll 20 and may be rotated in the same direction as the rotation of roll 20 at approximately 10 percent of the speed of rotation of roll 20. For example, the wire mesh drum may rotate at a speed of approximately 15 to 45 RPM with an abrasive roll 20 having approximately a 24 inch diameter rotating at approximately 150 to 450 RPM.

Figure 6:
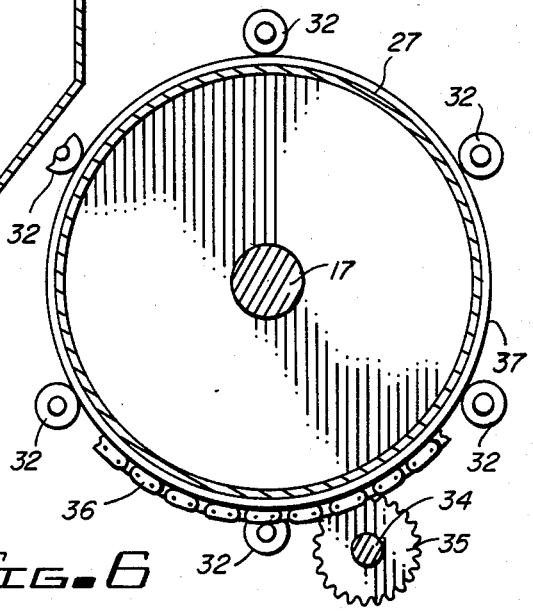
FIG. 6 is a cross-sectional view of FIG. 2 taken along the line 6—6.

The wire mesh drum 27 is rotated by an electric motor 33 through a drive shaft 34 and its associated sprocket 35, sprocket chain 36 and sprocket wheel 37 mounted on the left end of the wire mesh drum, as shown in FIGS. 2 and 6.

Figure 4:
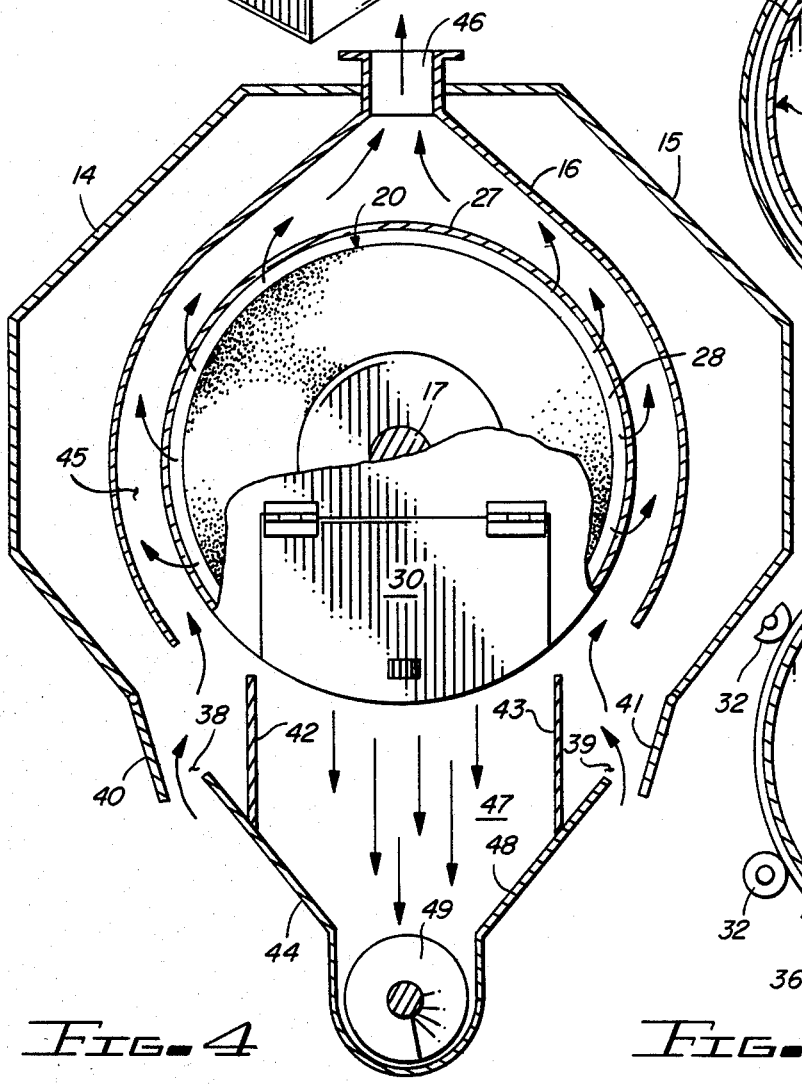
FIG. 4 is a cross-sectional view of FIG. 2 taken along the line 4—4.

As noted from FIG. 4, cylindrical hood 16 is mounted to surround at least the top half of the coaxially mounted roll 20 and wire mesh drum 27. The bottom portion of the hood is open for receiving a flow of air which is drawn into the housing 11 through a pair of openings 38 and 39, located longitudinally along each side of the housing. The openings 38 and 39 are each controlled by a hinged cover or door 40 and 41, respectively, and forming a part of the surface of the sides 14 and 15 of housing 11. A pair of baffles 42 and 43 mounted inside the lower porton 44 of housing 11 direct the air introduced or drawn into the housing into the annular space 45 formed between the outer periphery of the wire mesh drum 27 and the inside surface of hood 16. Some of the indrawn air also passes through the annular space 28 between the outer periphery of roll 20 and inner surface of the wire mesh drum 27. As the air passes upward through annular spaces 28 and 45, it becomes laden with lint that is being removed from the cottonseed and then exits through the housing 11 by means of an exhaust port 46 at the top of the hood 16. A fan, cyclone collector, and corresponding duct work is appropriately attached to exhaust port 46 so as to create the air flow heretowith described and provide means of collecting the lint.

Referring to FIGS. 2 and 4, a motes outlet 47 is formed at the bottom of the wire mesh screen and preferably extends substantially the length of the roll 20. In forming the motes outlet, the walls of the lower portion 44 of housing 11 taper inwardly forming a trough 48 within which is mounted a conveyor in the form of an auger 49 which move motes falling thereon to the right end of the trough, as shown in FIG. 2, and into an outlet 50 which communicates with a suitable receiver.

As the seeds enter the delinting apparatus and move along and around the outer periphery of the abrasive segments 20A–20J and held thereon by the rotating wire mesh drum 27, they travel in a circular spiral path from the left to the right of the delinter, as shown in FIG. 2. As the seed moves along this path rubbing on the abrasive surface of the segments back and forth between it and the wire mesh drum 27, the lint is dislodged from the seeds and is entrained in the air stream moving through the delinter which carries it out of the apparatus, passing through exhaust port 46 and into the attached duct work (not shown).

As the abrasive segments 20A–20J wear, and the diameter of the mandrel formed, thereby reducing in size, the diameter of the wire mesh drum 27 is adjusted to compensate for this wearing activity thereby keeping the annular space 28 substantially the same along the perimeter of the roll 20 where the delinting action takes place.

As the seeds make their way around the interior of the housing and toward the end thereof, trash particles, such as dirt, hulls, meats and the like, fall between the mesh of drum 27 to be collected in trough 48 and drawn by auger 49 into outlet 50.

As will now be appreciated in view of the foregoing description of the preferred embodiment, the disclosed delinter apparatus provides a relatively noiseless and energy efficient means of delinting cottonseed as compared with some conventional equipment. The rotor assembly of the roll segment structure moves the seeds through the device with minimal hold-up time thereby enhancing the quality of the lint by minimizing the absorbtion of seed oils, reducing seed breakage and pluggage of the wire mesh screen of drum 27.

Although but one embodiment of the present invention has been illustrated and described, it will be apparent to those skilled in the art that various changes and modifications may be made therein without departing from the spirit of the invention or from the scope of the appended claims.

What is claimed is:

1. An apparatus for delinting cottonseed comprising:

a generally cylindrical wire mesh drum means, an abrasive rotor disposed within said drum means whereby an annular space is provided between said rotor and the interior of said drum means, means for rotating said drum means and said rotor relative to each other in the same direction, said drum means rotating at a slower speed than said rotor, an inlet whereby cottonseed is introduced into said annular space, at least one cottonseed outlet from said annular space, a lint collection hood formed partially around and along the length of said drum means for receiving lint dislodged from the cottonseed in said annular space and forced through said drum means upon the relative rotation of said drum means and said rotor, and means for causing a stream of air drawn into said apparatus to pass through said annular space and out of said apparatus.

2. The apparatus set forth in claim 1 wherein:

said rotor comprises a plurality of axially aligned shaft mounted abrasive sleeve-like segments, said segments at each end of said rotor comprising conical configurations tapering away from the outer periphery of the remainder of said segments toward the shaft on which said segments are mounted.

3. The apparatus set forth in claim 2 wherein:

said inlet is formed at one end of said rotor.

4. The apparatus set forth in claim 3 in further combination with:

helical means for moving cottonseed received from said inlet into said annular space.

5. The apparatus set forth in claim 1 in further combination with:

a conveyor mounted in said apparatus below said drum means for moving motes from the cottonseed to a collection means.

6. The apparatus set forth in claim 1 in further combination with:

means for adjustably positioning said drum means relative to said rotor.

7. The apparatus set forth in claim 1 wherein:

said means for rotating said drum means and said rotor comprises a separate means for each of said drum means and said rotor.

8. The apparatus set forth in claim 1 in further combination with:

cover means for adjustably closing said outlet for controlling the time the cottonseeds are in said annular space.

9. The apparatus set forth in claim 1 wherein:

said annular space tapers outwardly from said inlet where cottonseed is introduced into said annular space toward the outlet end of said annular space.

* * * * *